US005927999A

United States Patent [19]

Shimojyo

[11] Patent Number: 5,927,999

[45] Date of Patent: Jul. 27, 1999

[54] POWER JACK HAVING THREE MOVABLE CONTACTS AROUND A CENTER PIN

[75] Inventor: Yasuhiro Shimojyo, Isesaki, Japan

[73] Assignee: Hosiden Corporation, Osaka, Japan

[21] Appl. No.: 09/060,150

[22] Filed: Apr. 15, 1998

[30] Foreign Application Priority Data

Apr. 16, 1997 [JP] Japan ..... 9-099101

[51] Int. Cl.[6] ..... H01R 9/09

[52] U.S. Cl. ..... 439/63; 439/856; 439/891

[58] Field of Search ..... 439/63, 581, 675, 439/744, 733.1

[56] References Cited

U.S. PATENT DOCUMENTS 4,491,382 1/1985 Ishikaya ..... 439/733.1
4,964,814 10/1990 Tengler et al. ..... 439/581
5,007,851 4/1991 Matsumoto ..... 439/733.1
5,741,146 4/1998 Henry et al. ..... 439/944

FOREIGN PATENT DOCUMENTS 64-33867 3/1989 Japan ..... 439/63

*Primary Examiner*—Neil Abrams
*Assistant Examiner*—J. F. Duverne
*Attorney, Agent, or Firm*—Pollock, Vande Sande & Amernick

[57] ABSTRACT

A conductive pin (22) is planted on the inside of the rear end wall (40) of a jack body (21) in alignment with the center axis of its plug insertion hole (27), and three movable contacts (23, 24, 25) formed in one piece of a leaf spring material are disposed around the conductive pin (22) in the body (21). The movable contacts resiliently engage the peripheral surface (73) of a power plug (72) inserted into the plug insertion hole (27), implementing a three-point contact therebetween.

6 Claims, 6 Drawing Sheets

POWER JACK HAVING THREE MOVABLE CONTACTS AROUND A CENTER PIN

BACKGROUND OF THE INVENTION

The present invention relates to a power jack for use in portable electronic/electrical equipment, for instance.

Portable equipment such as a portable tape recorder usually works on a battery. In places where a commercial power supply system is available, it is customary to use an adaptor to feed therefrom DC power to a power jack of the portable equipment.

FIG. 1 schematically depicts the construction of a conventional power jack of this kind. The power jack has a body 11 of an insulating material, in which a conductive pin 12 and a movable contact piece or strip 13 are provided. The body 11 has in its front a plug insertion hole 14. The conductive pin 12 is planted on the inside of a rear end wall of the body 11, and extends forwardly thereof in alignment with the center axis of the plug insertion hole 14. A terminal 15 is attached to the rear end of the conductive pin 12 extending out from the body 11.

The movable contact piece 13, which extends in a direction of from front to rear of the body 11, has its forward end portion bent to form a base portion 16 that extends along the inner wall surface of the bottom of the body 11. A terminal 17 formed integrally with the base portion 6 is extended to the outside of the body 11. The movable conductor piece 13 further has its intermediate portion extended toward the conductive pin 12 and then bent gently into a shallow, inverted V-letter shape. The free end of the movable contact piece 13 is held in resiliently biased engagement with the rear end face of the body 11 on the inside thereof.

As a power plug (not shown) is fitted into the plug insertion hole 14, the movable contact piece 13 comes into contact with a cover conductor forming the cylindrical peripheral surface of the power plug, and at the same time, the conductive pin 12 gets into engagement with a contact in the plug, thus establishing electric connection between the plug and jack.

With the conventional power jack of the above construction, however, the movable contact piece 13 makes a one-point contact with the cover conductor of the mating plug, and hence they are readily forced out of contact by vibration or prying—this gives rise to the problems of possible short breaks and a poor retention force for retaining the power plug. Another problem is that the one-point contact structure of an extremely small contact area inevitably lowers the current carrying capacity of the power jack, resulting in a severely limited allowable current value.

SUMMARY OF THE INVENTION

It is therefore an object of the present invention to provide a power jack that solves the abovementioned problems of the prior art and hence has a construction which excludes the possibility of short breaks by vibration or prying, provides a sufficient retention force for retaining the mating plug and permits a large current flow.

According to the present invention, there is provided a power jack which comprises a body of an insulating material and having a forwardly opening plug insertion hole, a conductive pin planted on the inside of the rear end wall of the body and extended in alignment with the center axis of the plug insertion hole, and a contact member having three movable contacts formed in one piece of a leaf spring material and disposed around the conductive pin in the body so that they resiliently contact the peripheral surface of the mating plug fitted in the plug insertion hole.

The contact member is made up of: a substantially rectangular plate-like base portion; a first movable contact piece bent upwardly from the front marginal edge or extremity of the base portion and extended toward the rear end wall of the body, the free end of the first movable contact being resiliently biased and locked to the rear wall of the body; a pair of arms extended from both sides of the rear end of the plate-like base portion in a manner to surround the center axis of the plug insertion hole; and second and third movable contacts extended forwardly from free ends of the pair of arms.

DETAILED DESCRIPTION OF THE PREFERRED EMBODIMENT

Figure 1:
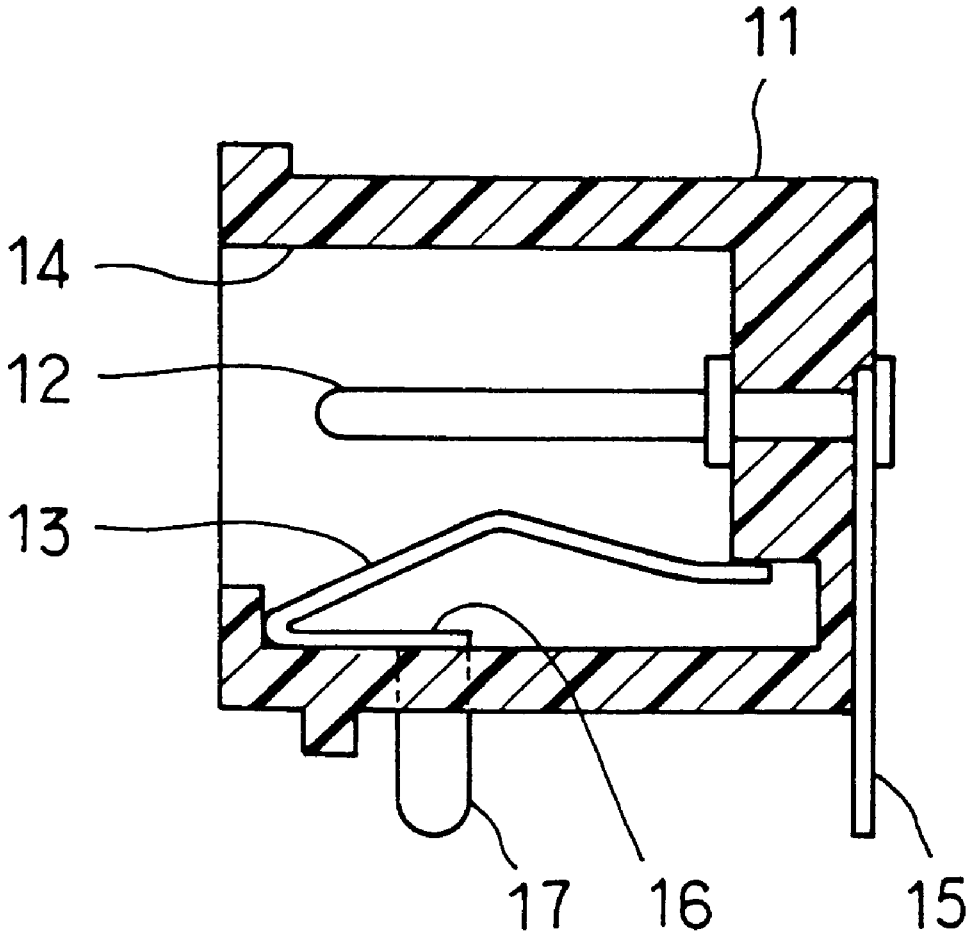
FIG. 1 PRIOR ART
FIG. 1 is a sectional view showing a conventional power jack.

With reference to the drawings, an embodiment of the present invention will be described in detail.

FIGS. 2A through 2D illustrate a power jack in accordance with an embodiment of the present invention. The power jack has a body 21 of an insulating material, in which there as mounted, as electrical connecting means, a conductive pin 22 and three movable contacts 23, 24 and 25. A description will be given first, with reference to FIGS. 3 through 7, of the configuration of each part of the power jack.

As depicted in FIGS. 3A to 3E, the body 21 is box-shaped and has a circular plug insertion hole 27 opening into a forward surface 26 of the body 21 and extending to its rear end wall 40. The body 21 has formed in its rear end face 39 a substantially a square, shallow recess 28 with marginal edges on all sides thereof. The rear end wall 40 of the body 21 has substantially triangular windows 36 and 37 with vertexes at two upper corners of the recess 28 and having oblique sides extending slightly across the perimeter of the plug insertion hole 27. The triangular windows 36 and 37, separated by a coupling portion 29 formed therebetween, extend forwardly and terminate just short of the insertion hole opening in forward surface 26 of the body 21. Hence, the triangular windows 36 and 37 communicate with the plug insertion hole 27 in the body 21.

Figure 3C:
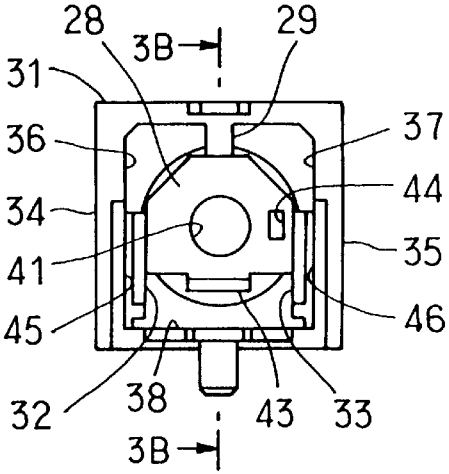
FIG. 3C is a rear view of the jack body.

Further, the rear end wall 40 of the body 21 has a substantially a rectangular window 38 formed therethrough and having its bottom flush with the lower side of the recess 28. The window 38 also extends forwardly in the plug insertion hole 27 and terminates just short of the front opening 26 of the body 21. The rear end wall 40 is joined to both side walls of the body 21 through coupling portions 32 and 33 formed between the windows 38, 36 and 37, respectively, and is further joined to the upper wall 31 of the body 21 through the coupling portion 29. The rear end wall 40 situated behind the plug insertion hole 27 has, as depicted in FIG. 3C, a virtually pentagonal configuration when viewed from the rear side of the body 21. Accordingly, the body 21 has a total of three windows 36, 37 and 38 as viewed from behind.

Figure 3B:
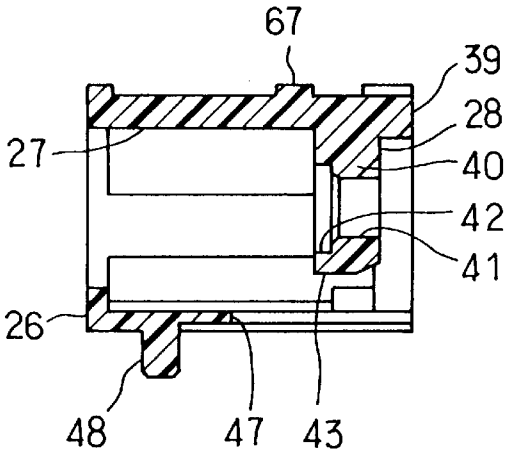
FIG. 3B is a sectional view taken on the line 3B—3B in FIG. 3C.

As depicted in FIG. 3B, the rear end wall 40 has a through hole 41 formed therethrough in alignment with the center axis of the plug insertion hole 27 and having its forward end portion 42 enlarged into a large-diameter section. The rear end wall 40 has a protrusion 43 extending downward from its underside and a rectangular recess or depression 44 in its outer wall surface.

Figure 3E:
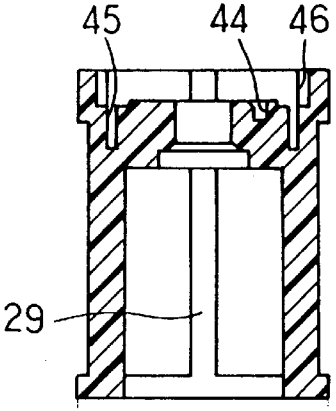
FIG. 3E is a sectional view taken on the line 3E—3E in FIG. 3A.
Figure 3A:
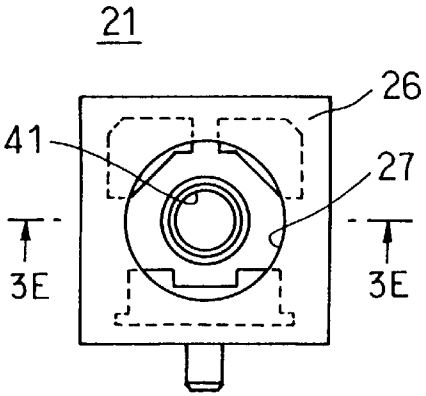
FIG. 3A is a front view of the body of the jack depicted in FIG. 2.
Figure 3D:
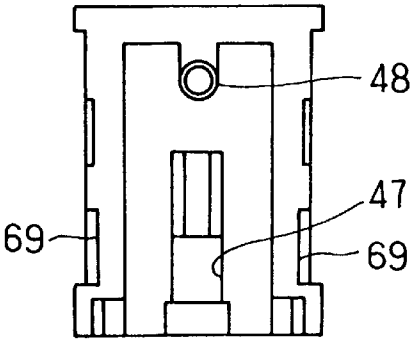
FIG. 3D is its bottom view.

As shown in FIGS. 3C and 3E, there are formed, in both coupling portions 32 and 33 on the rear of the body 21, slots 45 and 46 that are elongated across the coupling portions 32 and 33, respectively. The body 21 has formed in its bottom a rectangular notch 47 extending forwardly from the rear side. A pin 48 extending down from the underside of the body 21 serves as a positioning means at the time of installation of the power jack on associated equipment.

Figure 4:
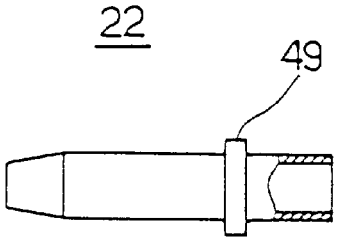
FIG. 4 is a side view of a conductive pin in FIG. 2.

As shown in FIG. 4, the conductive pin 22 has a tapered front end and a flange 49 formed near its rear end portion, which is hollowed into a cylindrical configuration.

Figure 5A:
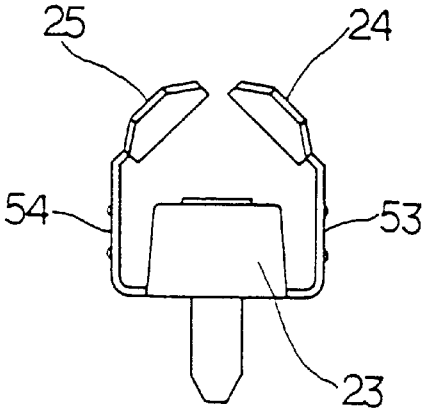
FIG. 5A is a front view of a contact member in FIG. 2.
Figure 5B:
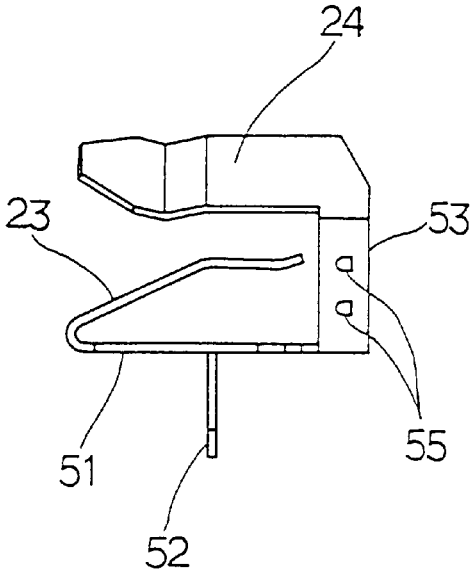
FIG. 5B is its side view.
Figure 5C:
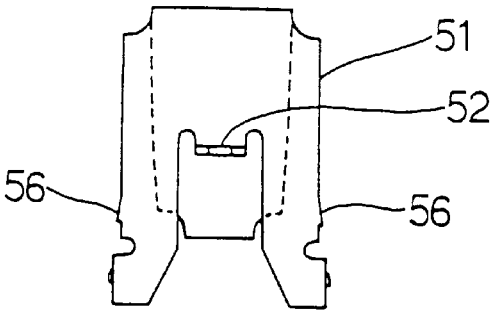
FIG. 5C is its partly-cut-away bottom view.

Turning next to FIGS. 5A, 5B and 5C, a contact member 50 will be described which has the three movable contacts 23, 24 and 25 formed in one piece of a leaf spring material.

The contact member 50 has a base portion 51 whose rear half portion is divided into three parts, i.e., a central section and two side side sections. The central section is bent down at right angles along its base to form a terminal 52, and the two side sections have outwardly extending arm-like portions bent at right angles along side marginal edges of the rear end portion of the base portion 51 and extended in the opposite direction to the terminal 52, forming a pair of opposite spaced arms 53 and 54. The arms 53 and 54 each have a pair of arcuate raised ribs or bosses 55 for forced engagement with a mating power plug. Extended from the top end portions of the arms 53 and 54 toward the plug insertion hole 27 are the first and second movable contacts 24 and 25. The base portion 51 also has a pair of bosses 56 for forced engagement with the power plug as shown in FIG. 5C.

The first movable contact 23 is extended upwardly at an acute angle from the base portion 51 and has its free end located near the arms 53 and 54 as depicted in FIG. 5B. The intermediate portion of the first movable contact 23 is bent gently into a shallow, inverted V-letter configuration.

The second and third movable contacts 24 and 25 are extended from the top end portions of the arms 53 and 54 in a direction parallel to the base portion 51 but opposite the direction in which the first movable contact 23 is extended. The movable contacts 24 and 25 are bent toward each other so that they are oblique to the arms 53 and 54, respectively. Further, the movable contacts 24 and 25 have their free ends bent to form protrusions facing toward the movable contact 23.

Figure 6A:
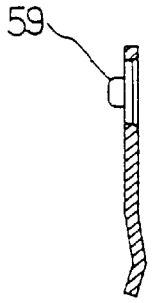
FIG. 6A is a sectional view of a terminal 57 in FIG. 2.
Figure 6B:
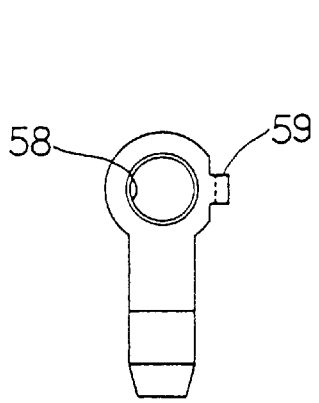
FIG. 6B is its front view.

FIGS. 6A and 6B depict a terminal 57 that is to be crimped onto the aforementioned conductive pin 22. The terminal 57 has at one end a hole 58 formed therethrough for insertion of the base end portion of the conductive pin 22 and a lug 59 protrusively provided on one side of that end portion for engagement use.

Figure 7A:
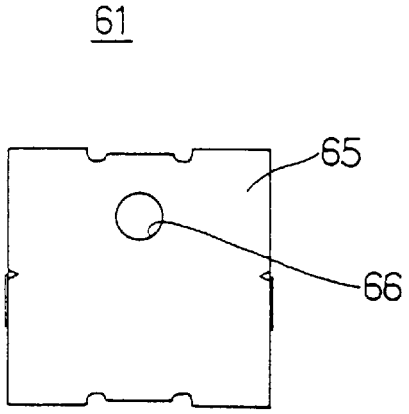
FIG. 7A is a plan view of a mounting plate in FIG. 2.
Figure 7B:
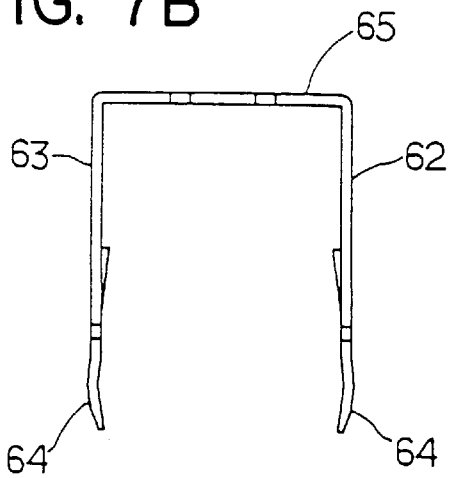
FIG. 7B is its front view.
Figure 7C:
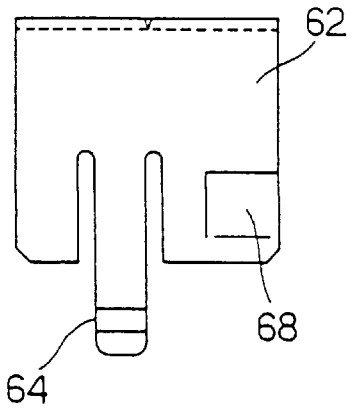
FIG. 7C is its side view.

FIGS. 7A, 7B and 7C illustrate substantially an inverted U-shaped covering plate or frame 61 with which the top 31 and both sides 34 and 35 of the body 21 are covered. Side panels 62 and 63 of the frame 61 have lugs or tabs 64 extending down therefrom for engagement use. A top panel 65 has a hole 66 formed therethrough for receiving a protrusion 67 on the top 31 of the body 21 (see FIG. 3B) so that the covering frame 61 is positioned in place relative thereto.

Referring next to FIGS. 2A through 2D, assembling of respective parts will be described below.

In the first place, the movable contacts 23, 23 and 25 integrally joined together through the arms 53, 54 and the base portion 51 are incorporated into the body 21. This is done by inserting the base portion 51 and the first movable contact 23 into the window 38 and the second and third movable contacts into the windows 36 and 37, respectively, from the rear side of the body 21, followed by inserting the arms 53 and 54 into the slots or grooves 45 and 46 cut in the rear of the body 21, respectively. At this time, the base portion 51 is pressed by its bosses 56 against the inner wall surfaces of the two side walls 34 and 35 and locked therein, and the arms 53 and 54 are locked by their ribs or bosses 55 in the slots 45 and 46.

Figure 2A:
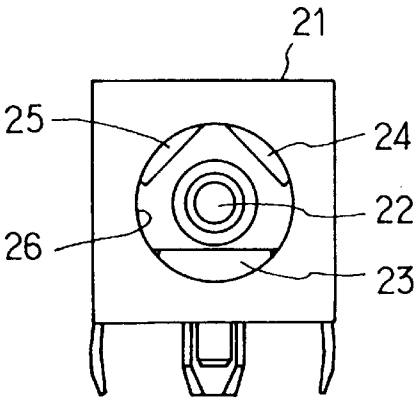
FIG. 2A is a front view illustrating an embodiment of the present invention.
Figure 2B:
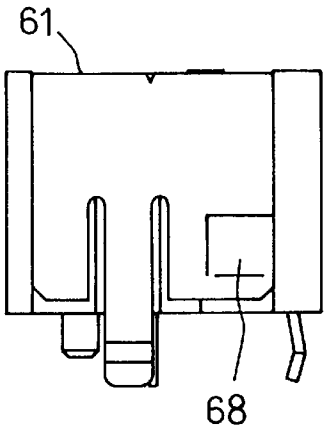
FIG. 2B is its side view.
Figure 2C:
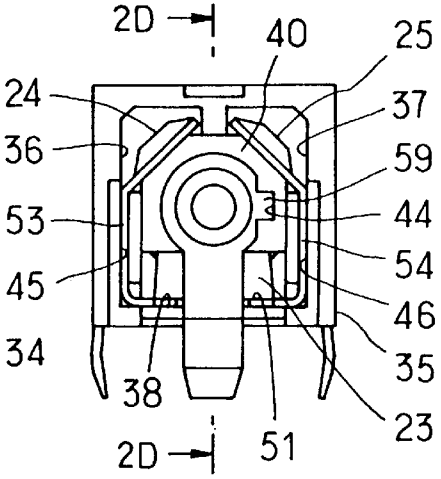
FIG. 2C is its rear view.
Figure 2D:
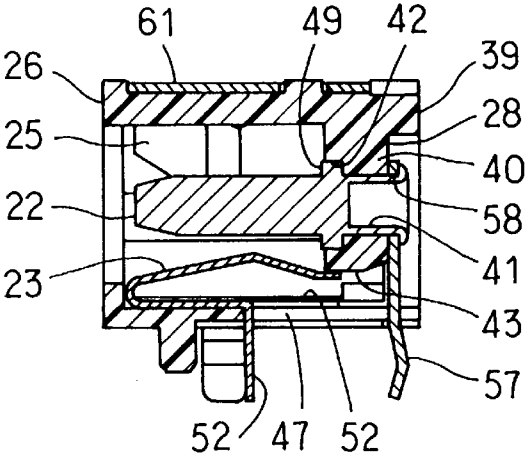
FIG. 2D is a sectional view taken on the line 2D—2D in FIG. 2C.

As depicted in FIG. 2D, the movable contact 23 has its free end resiliently biased into engagement with the protrusion 43 of the rear end wall 40. The terminal 52 extending down from the base portion 51 is positioned in the recess 47 so that it protrudes beyond the underside of the body 21.

Next, the base end portion of the conductive pin 22 is fitted into the through hole 41 of the rear end wall 40 through the plug insertion hole 27 from the front of the body 21. The conductive pin 22 is fixed with its flange 49 held in engagement with the large diameter section 42 of the through hole 41. The base end portion of the conductive pin 22 projecting out rearwardly of the body 21 is received in the hole 58 of the terminal 57. The terminal 57 is crimped onto the conductive pin 22, and hence is fixed thereto, while at the same time the conductive pin 22 is prevented from coming off. The lug 59 of the terminal 57 is engaged with the recess 44 (FIG. 3C) formed in the exterior surface of the rear end wall 40, whereby turning of the terminal 57 is arrested. The lower end portion of the terminal 57 projects out of the bottom of the body 21 as is the case with the terminal 52.

Thereafter, the covering frame 61 is mounted onto the body 21, with which the assembling is completed. The covering frame 61 is fixed to the body 21 by pressing inward protrusions 68 (see FIG. 7C) of the side panels 62 and 63 (see FIGS. 7B and 7C) into engagement with recesses 69 (FIG. 3D) formed in the side walls 34 and 35 of the body 21.

The power jack 71 thus assembled has the three movable contacts 23, 24 and 25 disposed around the conductive pin 22 planted on the inside of the jack body 21 in alignment with the center axis of the plug insertion hole 27.

Figure 8A:
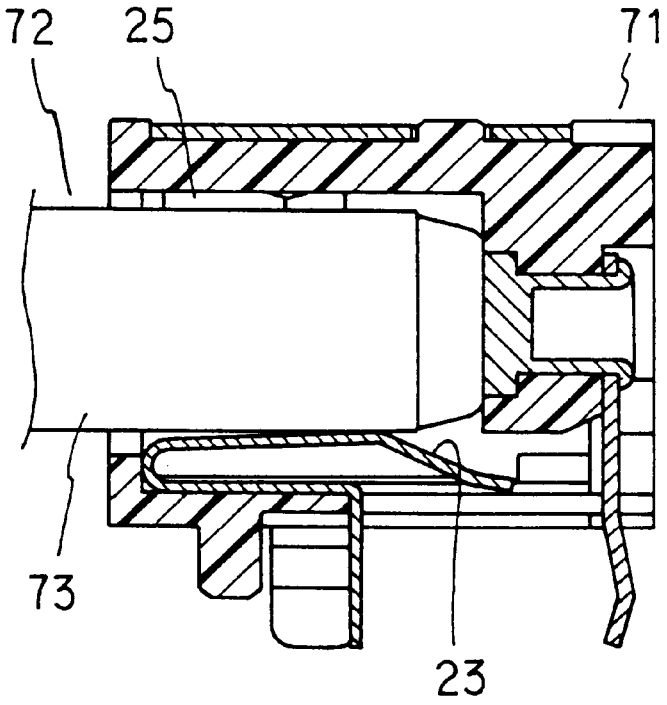
FIG. 8A is a sectional view illustrating the power jack of FIG. 2 with a plug inserted therein.
Figure 8B:
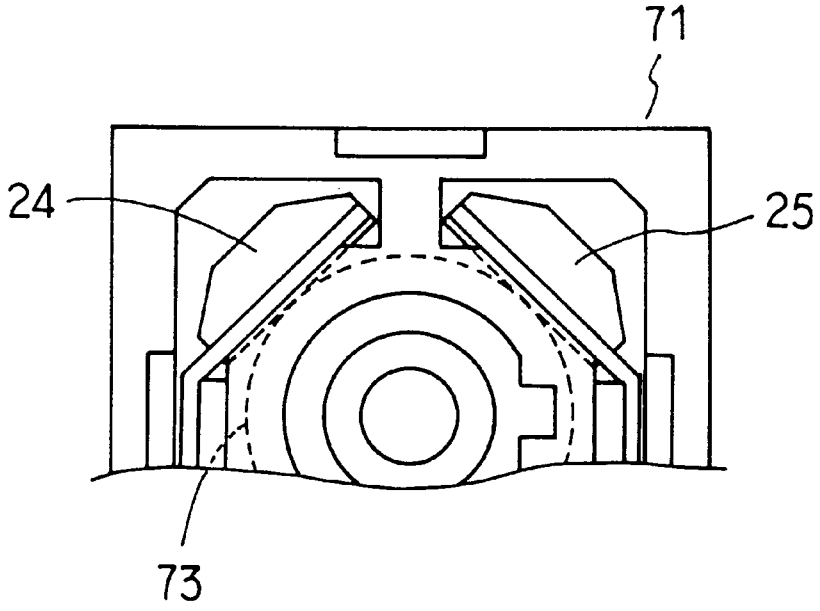
FIG. 8B is its partly-cut-away rear view.

FIG. 8A is a longitudinal sectional view showing the power jack 71 with a mating plug 72 received therein and FIG. 8B its partly cut-away rear end view. The three movable contacts 23, 24 and 25 are in resilient contact with a cover conductor 73 forming the peripheral surface of the plug 72.

EFFECT OF THE INVENTION

As described above, according to the present invention, the power jack has, for contact with the cover conductor of the mating plug, the three-point-contact structure made up of three movable contacts disposed around the conductive pin so that they will surround the mating plug when it is inserted into the jack. Even if vibrated or pried, such a contact structure always ensures at least two-point type of contact between the jack and the plug, hence it effectively prevents the occurrence of short breaks by vibrations or prying.

Moreover, the three-point-contact structure provides sufficient mechanical retentive force for the plug fitted therein, and permits a large current flow as compared with the conventional one-point-contact structure.

It will be apparent that many modifications and variations may be effected without departing from the scope of the novel concepts of the present invention.

What is claimed is:

1. A power jack comprising:

a body of an insulating material and having a forwardly opening plug insertion hole and a rear end wall;

a conductive pin planted on the inside of said rear end wall of said body and extended forwardly in alignment with the center axis of said plug insertion hole, and a contact member having first, second and third movable contacts formed in one piece of a leaf spring material and disposed around said conductive pin in said body for resilient contact with the peripheral surface of a plug that has been inserted into said plug hole, said contact member comprising a substantially rectangular plate-like base portion, said first movable contact being bent upwardly from a front marginal edge of said base portion and extended toward said rear end wall of said body, a free end of said first movable contact being resiliently biased into engagement with said rear end wall of said body, a pair of arms extended from rear marginal side edges of said base portion in surrounding relation to said center axis of said plug insertion hole, and said second and third movable contacts extending forwardly from free ends of said pair of arms.

2. The power jack of claim 1, wherein said first, second and third movable contacts of said contact member have inner surfaces disposed opposite said center axis but spaced therefrom.

3. The power jack of claim 1, wherein said contact member has a terminal extending down from a rear edge of said base portion between said pair of arms.

4. The power jack of claim 1, wherein said second and third movable contacts have an upward projection bent from a front end portion of each contact toward said center axis.

5. The power jack of claim 1, wherein said pair of arms have first arm sections flush with said base portion and extending rearwardly from both sides of the rear marginal edge of said base portion and second arm sections extending upwardly from outside marginal portions of rear ends of said first arm sections at right angles to said base portion toward said center axis, said second and third movable contacts extending in parallel to said center axis from forward marginal edges of said free ends of said second arm sections.

6. The power jack of claim 1, wherein said body has in its rear end wall substantially triangular windows formed therethrough at two upper corners of an end face of the body, said windows having oblique sides located near the perimeter of said plug insertion hole in opposed relationship with said center axis, said triangular windows extending forwardly in parallel to said center axis but terminating just short of the front of said body, and said body further has in its rear end wall a rectangular window formed therethrough near a lower side of said end face, said rectangular window extending forwardly in parallel to said axis but terminating just short of the front of said body, and wherein said second and third movable contacts are inserted in said triangular windows along their oblique sides and said plate-like base portion is inserted in said rectangular window along said lower side.

* * * * *